United States Patent [19]

Marcellis et al.

[11] Patent Number: 4,501,594

[45] Date of Patent: Feb. 26, 1985

[54] ANIONIC POLYHYDROXY POLYPHENYL COMPOUNDS AS DISPERSANTS FOR AQUEOUS SLURRIES OF CARBONACEOUS MATERIALS

[75] Inventors: Alphonso W. Marcellis, Boonton; Grannis S. Johnson, Plainfield; Reuben H. Grinstein, Denville, all of N.J.

[73] Assignee: Diamond Shamrock Chemicals Company, Dallas, Tex.

[21] Appl. No.: 544,076

[22] Filed: Oct. 21, 1983

[51] Int. Cl.[3] ..... C10L 1/18

[52] U.S. Cl. ..... 44/51; 44/76; 44/78; 252/351; 252/353; 260/505 C; 260/505 S; 260/512 C

[58] Field of Search ..... 44/51, 78, 76; 252/351, 252/311, 308, 309, 353; 260/505 S, 505 C, 512 C

[56] References Cited

U.S. PATENT DOCUMENTS

| | | | |
|---|---|---|---|
| 4,182,613 | 1/1980 | Stover et al. | 44/51 |
| 4,282,006 | 8/1981 | Funk | 44/51 |
| 4,325,890 | 4/1982 | Reitz et al. | 206/512 C |
| 4,330,301 | 5/1982 | Yamamura et al. | 44/51 |
| 4,391,645 | 7/1983 | Marcellis et al. | 106/90 |

*Primary Examiner*—William R. Dixon, Jr.
*Assistant Examiner*—Margaret B. Medley
*Attorney, Agent, or Firm*—Neal T. Levin

[57] ABSTRACT

Aqueous carbonaceous slurries having reduced viscosity, a stabilized network of carbonaceous material in water and improved pumpability are obtained by having present as a dispersant one or more particular water soluble sulfomethylated hydroxy aromatic products. Examples of dispersants are the water soluble sulfomethylation product of the water soluble residue obtained from resorcinol production by the alkaline fusion method, sulfomethylated phenol and sulfomethylated bisphenol A.

12 Claims, No Drawings

ANIONIC POLYHYDROXY POLYPHENYL COMPOUNDS AS DISPERSANTS FOR AQUEOUS SLURRIES OF CARBONACEOUS MATERIALS

BACKGROUND OF THE INVENTION

1. Field of the Invention

This invention relates to aqueous carbonaceous slurries and more particularly to slurries stabilized with water soluble sulfomethylated hydroxy aromatic products.

2. Description of the Prior Art

Transport is one of the major problems involved in use of particulate carbonaceous materials such as coal. One method of transport involves aqueous slurries. However, aqueous slurries of finely ground coal containing over 55 weight percent solids are difficult to pump with slurry pumps. This is because as the solids level is increased over 50 weight percent, water and solids tend to separate causing coal particles to build up in various areas in the pumping system. This dewatering of the slurry causes blockage and jamming in the pumping system.

On the other hand, decreasing the weight percent of water in aqueous coal slurries is desirable because water is a major contributor to the cost of transport and processing operations. The less water transported the greater the volume of coal that can be moved, resulting in transport efficiencies. Further, water resources are limited. Also, during burning of coal, a significant amount of heat is required to vaporize the water. As the weight percent of water decreases, the efficiency of the coal burning process increases. Hence use of higher weight percent solids aqueous carbonaceous slurries than were heretofore feasible would be of great importance.

It is known that anionic surfactants with sulfonate groups are dispersants for coal water slurries. Examples taken from the literature appear below.

U.S. Pat. No. 4,282,006—Funk, Aug. 4, 1981, describes a pipeline pumpable coal water slurry having a high content of coal particles with a minimum of void spaces and a maximum of particle surface area to enhance dispersing effects generated by electrolytes and/or dispersing agents added to the slurry. For anionic dispersing agents, see Column 29, line 53 to Column 31, line 9.

U.S. Pat. No. 4,330,301—Yamamura et al, May 18, 1982, describes anionic dispersants for aqueous coal slurries which are sulfonation products of polycyclic aromatic compounds, salts thereof and formaldehyde condensates thereof.

SUMMARY OF THE INVENTION

Stabilized aqueous carbonaceous slurries having reduced viscosity, a stabilized network of carbonaceous material in water and improved pumpability are obtained by using one or more particular water soluble sulfomethylated hydroxy aromatic products as a dispersant, said dispersant present in an amount sufficient to reduce the viscosity of the slurry, stabilize the network of carbonaceous material in water and improve pumpability.

DESCRIPTION OF THE PREFERRED EMBODIMENTS

One or more water soluble sulfomethylated hydroxy aromatic products are present in the slurry in amounts sufficient to reduce the viscosity of the slurry, stabilize the network of carbonaceous material in water and improve the pumpability of the slurry. For example, from about 0.05% by weight to about 2.0% by weight, preferably from 0.05% by weight to about 0.5% by weight, of the dispersant based on the weight of the carbonaceous material can be used. The resulting slurries will generally have about 60% by weight solids and 40% by weight water to which the dispersant solution is added.

Sulfomethylated Aromatic Products

The water soluble sulfomethylated hydroxy aromatic products are water soluble hydroxy aromatic products having the following structure:

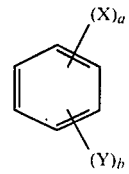

where

X is —OH or —O Cation

Y is

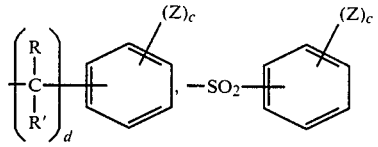

or R″ a is 1, 2 or 3; b is 0, 1 or 2 c is 0, 1 or 2; d is 0 or 1

Z is —OH or —O Cation

R and R′ are —H or lower alkyl and may be the same or different

R″ is an alkyl group of 1 to 20 carbon atoms with the proviso that where a is 1, b is 0, 1 or 2 where a is 2, b is 0 or 1 and where a is 3, b is 0 which have been sulfomethylated.

Examples of R and R′ are hydrogen, methyl, ethyl, propyl and isopropyl and R and R′ can be the same or different.

Examples of R″ which can be straight or branched are methyl, ethyl, propyl, isopropyl, butyl, octyl, isooctyl, nonyl, decyl and dodecyl.

Examples of cations for —O Cation in both X and Z are the alkali metals such as sodium, potassium and lithium, alkaline earth metals such as barium, calcium and magnesium, transition metals such as iron, chromium, nickel, zinc and manganese, ammonium and substituted ammonium (—H nitrogen bases) such as $NH_4$, $HNR_3''$ where R″ is —H or straight or branched chain lower alkyl such as methyl, ethyl, propyl, isopropyl, butyl and amyl and R″ can be the same or different, —H alkanolamine such as —H ethanolamine, —H propanolamine, —H diethanolamine, —H triethanolamine, —H morpholine, —H piperazine and —H piperidine.

Further, condensates of the foregoing water soluble sulfomethylated hydroxy aromatic products with from about 0.25 to about 3.0 moles of formaldehyde per mole of the foregoing can be used.

Examples of useful water soluble sulfomethylated hydroxy aromatic products are sulfomethylated phenol, sulfomethylated cresol, sulfomethylated nonyl phenol, sulfomethylated monohydroxy biphenyl, sulfomethylated alpha-methyl benzyl p-phenol(sulfomethylated styrenated phenol), sulfomethylated 2,2'-bis(p-hydroxyphenyl)propane(sulfomethylated bis-phenol A), sulfomethylated 2,2'-bis-(p-hydroxyphenyl)methane(sulfomethylated bis-phenol F), sulfomethylated 1,2-dihydroxybenzene(sulfomethylated catechol), sulfomethylated 1,3-dihydroxy benzene(sulfomethylated resorcinol), sulfomethylated dihydroxy diphenyl, sulfomethylated trihydroxy diphenyl, the sodium salt of sulfomethylated phenol, the potassium salt of sulfomethylated styrenated phenol, the lithium salt of sulfomethylated bis-phenol A, the ammonium salt of sulfomethylated catechol, the magnesium salt of sulfomethylated styrenated phenol, the zinc salt of sulfomethylated monohydroxy biphenyl, the dimethyl amine salt of sulfomethylated monohydroxy biphenyl, the monoethanol amine salt of sulfomethylated bis-phenol A, the morpholine salt of sulfomethylated bis-phenol A, sulfomethylated dihydroxy diphenyl sulfone, and condensates of 0.6, 1.0 and 1.22 moles of formaldehyde and one more of sulfomethylated bisphenol A, respectively.

Further, there can be sulfomethylated the water soluble bottoms or residue containing polyhydroxy polyphenyl compounds obtained from resorcinol production by the alkaline fusion method (resorcinol bottoms). This method involves alkaline fusion of the disodium salt of m-benzenedisulfonic acid. A description of this method can be found in Encyclopedia of Chemical Technology, Kirk-Othmer, Third Edition, Volume 13, pages 48 and 49.

An example of water soluble resorcinol bottoms which can be sulfomethylated is one having the following properties and composition:

| Properties | |
|---|---|
| Color | Dark redish black |
| Viscosity, Poise (70% Solution at 23° C.) | 4 |
| Specific Gravity | 1.3 |
| Softening Point, ° C. | 80–90 |
| Volatiles at 300° C. | 60% (approx.) |
| Flash Point (COC), °C. | 204 |
| Ash | <1% |
| Iron | <0.5% |

| Composition | |
|---|---|
| Component | % By Wt. |
| Resorcinol | 2–8 |
| Dihydroxy diphenyl | 12–20 |
| Trihydroxy diphenyl | 25–35 |
| Higher molecular wt. polymers | Balance |

Where resorcinol bottoms are used in the examples herein, such material has the above properties and composition.

Sulfomethylation

Sulfomethylation of the foregoing hydroxy aromatic products is achieved by conventional sulfomethylation procedures, e.g., by reaction under alkaline conditions with sodium pyrosulfite (sodium metabisulfite) and 37% by weight aqueous solution of formaldehyde at 50°–100° C. In the sulfomethylation reaction, the quantities of hydroxy aromatic product, sodium pyrosulfite and formaldehyde can vary on a weight basis from about 1:2.04:0.66 to about 1:0.83:0.26 to provide for from about one to three sulfomethyl groups per ring.

Further, upon completion of the sulfomethylation reaction, additional formaldehyde can be introduced and reacted with the sulfomethylated material in amounts of from about 0.25 to about 3.0 moles of formaldehyde per mole of sulfomethylated hydroxy aromatic product to provide for a higher molecular weight product. In the case of sulfomethylated water soluble resorcinol bottoms, from about one to about three moles of formaldehyde can be used.

The resulting sulfomethylated material may be used as 100% active material or in aqueous solution. It can be in the form of it salts as indicated previously.

The term "carbonaceous materials" as used herein encompasses solid particulate carbonaceous fossil fuel materials which are crushed and milled to obtain finely divided particles suitable for use in pumpable water slurries. Generally, these materials are powdered or pulverized to a size where at least 80% will pass through a 200 mesh screen (U.S. Series). Useful carbonaceous materials include bituminous and anthracite coals, coke, petroleum coke, lignite, charcoal, peat, admixtures thereof and the like.

Water used in the slurry may be taken from any available source such as mine, well, river, or lake water or desalinated ocean water having a sufficiently low mineral salt content such that the electrochemistry of the bound water layer and carrier water interface can be controlled and corrosion of milling facilities, pipelines and furnaces will be minimized and controllable.

For a fuller understanding of the nature and advantages of this invention, reference may be made to the following examples. These examples are given merely to illustrate the invention and are not to be construed in a limiting sense.

Evaluation of Dispersants for Aqueous Carbonaceous Slurries

The following procedure was utilized in the evaluation of the products of the examples in aqueous coal slurries. This is achieved by determining the ability of the products to disperse or suspend coal dust uniformly in water by measuring viscosity and examining the sediment, if formed.

Apparatus Used 8-oz. paint cans
Low shear mechanical mixer with a double blade
Spatula
Stormer viscometer

Reagents Used

Water of known record hardness
Coal dust—Reference coal is Pittston Coal, 80% through 200 mesh (U.S. Series). Other types of coal and grind sizes can be substituted.
Dispersant

Procedure

1. A slurry of coal dust in water is prepared as follows. Coal dust is slowly added to water under agitation by a low shear mechanical mixer with a double blade. (Do not use a "Lightnin" high speed mixer.) Sides of the container are scraped regularly while mixing. The slurry is agitated for an additional hour to ensure uniformity.

2. Viscosity of the aqueous coal slurry is determined by weighing out 200 gram samples of the slurry into 8 oz paint cans. A specific quantity of product is added to each under vigorous agitation. All cans are closed tightly to prevent evaporation of water.

3. Each can is opened and each slurry is stirred with a spatula before viscosity measurements are made with a Stormer Viscometer. Weights are adjusted in order to find a reading as close as possible to 30 seconds and the correct weight for a 30-second viscosity is determined. Readings are repeated twice after stirring each time and should not differ by more than 2 seconds. Readings are repeated until consistent and the average of two readings taken.

4. Seconds and weight are converted into krebs units which are then converted to centipoise readings.

In the Examples, all percents by weight of dispersant are percents by weight of the dispersant solids based upon the weight of the carbonaceous material (coal).

EXAMPLE I

This example describes preparation of the dispersant by sulfomethylation of water soluble resorcinol bottoms.

A three-necked round bottom flask fitted with thermometer, mechanical stirrer and reflux condenser was charged with 47.0 grams of the previously described resorcinol bottoms composition, 48.0 grams of sodium pyrosulfite, 20.0 grams of 50% by weight aqueous solution of sodium hydroxide and 92.0 grams of water. Then, added dropwise was 42.0 grams of 37% by weight aqueous solution of formaldehyde. The flask was heated to 70° C., where an exotherm occurred and carried the temperature to 80° C. After the exotherm subsided, the flask was heated to reflux until the percent sodium pyrosulfite was 1.4% as determined by direct titration with iodine to a starch end point. The product was adjusted to 43% by weight solids. The weight ratio of resorcinol bottoms:sodium pyrosulfite:formaldehyde was 1:1.02:0.33.

EXAMPLE II

This example describes the preparation of the dispersant by sulfomethylation of water soluble resorcinol bottoms.

As in Example I, 184 grams of water, 40 grams of sodium hydroxide and 94 grams of the previously described resorcinol bottoms composition in powdered form were agitated and heated to 70° C. to dissolve. The solution was cooled to 50° C. and 96 grams of sodium pyrosulfite and 84 grams of 37% by weight aqueous solution of formaldehyde were added. An exotherm carried the temperature to 70° C. After the exotherm subsided, the reaction mixture was heated to reflux for about 20 hours. The product was filtered to remove residual solids. The filtrate had a pH of 10.85, a Brookfield viscosity of 27 cps (60 RPM, No. 1 spindle) and 47% by weight solids. The weight ratio of resorcinol bottoms:sodium pyrosulfite:formaldehyde was 1:1.02:0.33.

EXAMPLE III

This example describes the preparation of the dispersant from sulfomethylated water soluble resorcinol bottoms further condensed with formaldehyde.

A flask was charged with 150.0 grams of sulfomethylated resorcinol bottoms as prepared in Example I and 12 grams of 37% by weight aqueous solution of formaldehyde (4.4 grams of 100%, 0.15 mole) and refluxed for about 30 hours. The viscosity after this period increased from an initial Brookfield viscosity of 22.5 cps to 172 cps (60 RPM, No. 1 spindle). The reaction was terminated at this point and solids were determined as 46.0% by weight.

EXAMPLE IV

The products of Examples II and III were evaluated as dispersants for aqueous coal slurries using the previously described procedure. Table I sets forth the compositions.

The use of sulfomethylated resorcinol bottoms and sulfomethylated resorcinol bottoms further condensed with formaldehyde was found to be extremely effective in reducing the viscosity of a 60% by weight coal water slurry. The results shown in Table II demonstrate that both sulfomethylated resorcinol bottoms and the same further condensed with formaldehyde are very effective in reducing viscosity even at very low concentrations. Furthermore, at 0.1% concentration of dispersant solids based on weight of coal, the coal water slurries prepared using sulfomethylated resorcinol bottoms, even after standing for one week, gave a soft easily dispersed sediment while other commercial dispersants settled within one day to hard, very difficult to redisperse sediments.

TABLE I

| Component | % By Wt. |
|---|---|
| Pittston Coal (80% <200 mesh U.S. Sieve Series) | 60 |
| Distilled Water | Varies |
| Sulfomethylated product of Example II or Example III | Varies |

TABLE II

Viscosity vs. Dispersant Concentration of a 60/40 Pittston Coal Water Slurry Sulfomethylated Resorcinol Bottoms of Example II and Condensed Sulfomethylated Resorcinol Bottoms of Example III

| Dispersant of Example | Conc. of Dispersant (Solids) % by wt. of Coal | Viscosity (cps) | Sediment 1 Day Type | Sediment 7 Days Type |
|---|---|---|---|---|
| Blank | — | 1700 | — | — |
| II | 0.1 | 220 | Soft | Soft |
| | 0.2 | 190 | Firm | Firm |
| | 0.3 | 190 | Firm | Firm |
| Blank | — | 1700 | — | — |
| III | 0.1 | 240 | Firm | Firm |
| | 0.2 | 220 | Firm | Firm |

EXAMPLE V (Sulfomethylation of Styrenated Phenol)

A two liter, three-necked flask fitted with stirrer, water condenser and thermometer was charged with 198.0 grams (1.0 mole) of alpha-methyl benzyl p-phenol (styrenated phenol), 500.0 grams of water, 80.0 grams (1.0 mole) of 50% by weight sodium hydroxide, 190 grams (1.0 mole) sodium pyrosulfite and 162 grams of (2.0 moles) of 37% by weight aqueous solution of formaldehyde. The mixture was heated to 105° C. and refluxed. The mixture became clear after twenty-four hours. A sample (V A) was taken at this point and evaluated as a stabilizer for aqueous carbonaceous slurries. Similarly, samples were taken after thirty-two hours (V B) and forty-eight hours (V C) for evaluation. Solids concentrations of the products were found to be 37% by weight.

The weight ratio of styrenated phenol:sodium pyrosulfite:formaldehyde was 1.0:0.96:0.33.

EXAMPLE VI

(Sulfomethylation of Phenol)

In a manner similar to Example V, the following were mixed together: 188.0 grams (2.0 moles) of phenol, 190.0 grams (1.0 mole) sodium pyrosulfite, 162.0 grams (2.0 moles) 37% by weight aqueous solution of formaldehyde and 500 grams of water. The mixture was heated to reflux (105° C.-110° C.) and 72.0 grams of 50% by weight aqueous solution of sodium hydroxide (0.90 mole) added.

After eight hours of heating, a sample was removed for evaluation (VI A). Heating was continued for an additional fourteen hours (22.0 hours total) and another sample removed for evaluation (VI B).

After a total of thirty hours heating, a third sample was removed for evaluation (VI C). After heating for a total of forty-four hours a fourth sample was removed for evaluation (VI D).

The weight ratio of phenol:sodium pyrosulfite: was 1.00:1.01:0.32. Solids concentration of the products were found to be 37%.

EXAMPLE VII

(Sulfomethylation of Bis-Phenol A)

In a manner similar to Example V, the following were mixed together: 228.0 grams (1.0 mole), of 2,2'-bis(p-hydroxyphenyl)propane (bis-phenol A), 190.0 grams (1.0 mole) sodium pyrosulfite, 590.0 grams water, 162.0 grams (2 moles) of 37% by weight aqueous solution formaldehyde and 80.0 grams (1.0 mole) of 50% by weight aqueous solution of sodium hydroxide. The mixture was then heated at reflux (105° C.) and samples removed for evaluation as follows:

after eight hours: (VII A)
after twenty-four hours: (VII B)
after thirty-two hours: (VII C)
after forty-eight hours: (VII D)

The weight ratio of bis-phenol A:sodium pyrosulfite:formaldehyde was 1.00:0.83:0.26. Solids concentrations of the products were found to be 37% by weight.

EXAMPLE VIII

(Sulfomethylation of Catechol)

In a manner similar to Example V the following were mixed together: 220.0 grams (2.0 moles) of catechol (1,2-dihydroxy benzene), 190.0 grams (1.0 mole) of sodium pyrosulfite, 603.0 grams of water and 162.0 grams (2 moles) of 37% by weight aqueous solution of formaldehyde. The mixture was heated to reflux (105° C.) and samples removed for evaluation as follows:

after seven hours: (VIII A)
after twenty-four hours: (VIII B)
after thirty-one hours: (VIII C)
after forty-five hours: (VIII D)

The weight ratio of catechol:sodium pyrosulfite:formaldehyde was 1.00:0.96:0.27. Solids concentrations in the products were found to be 37% by weight.

The products of Examples V, VI, VII and VIII were evaluated as dispersants for aqueous coal slurries using the previously described procedure. The data collected are set forth in Table III below.

In Table III, products of Examples V, VI, and VII were evaluated on Pittston coal, 80% <200 mesh U.S. Sieve Series while products of Example VIII were evaluated on Ashland Coal, 80% <200 mesh U.S. Sieve Series. All dispersions contained 60% by weight of coal, based on total weight of the dispersion. The following is used to describe the sediment:

Soft—S
Semi-Firm—SF
Firm—F

TABLE III A

| | | Sulfomethylated Styrenated Phenol | | | | | | | |
|---|---|---|---|---|---|---|---|---|---|
| | Conc. of | Initial | Sediment | | | | | | Final |
| Dispersant of Example | Dispersant (Solids) % by wt. of coal | Viscosity (cps.) | 1 Day % by wt. | Type | 5 Days % by wt. | Type | 7 Days % by wt. | Type | Viscosity (cps.) |
| Blank | — | 2,570 | 67 | SF | 67 | SF | 53 | F | 2,460 |
| V A | 0.10 | 1,230 | 0 | S | 67 | F | | | 1,175 |
| | 0.20 | 975 | 0 | S | 80 | F | | | 900 |
| | 0.50 | 600 | 13 | S | 53 | F | | | 600 |
| | 0.75 | 460 | 13 | S | 33 | SF | 67 | F | 460 |
| V B | 0.10 | 1,180 | 7 | S | 73 | F | | | 1,100 |
| | 0.20 | 925 | 7 | S | 73 | F | | | 925 |
| | 0.50 | 633 | 13 | S | 33 | F | | | 600 |
| | 0.75 | 500 | 13 | S | 27 | F | | | 500 |
| V C | 0.10 | 1,150 | 13 | S | 73 | F | | | 1,100 |
| | 0.20 | 1,030 | 13 | S | 80 | F | | | 950 |
| | 0.50 | 733 | 7 | S | 27 | SF | 67 | F | 575 |
| | 0.75 | 500 | 7 | S | 20 | SF | 53 | F | 460 |

TABLE III B

| | | Sulfomethylated Phenol | | | | | |
|---|---|---|---|---|---|---|---|
| | Conc. of | Initial | Sediment | | | | Final |
| Dispersant of Example | Dispersant (Solids) % by wt. of coal | Viscosity (cps.) | 1 Day % by wt. | Type | 7 Days % by wt. | Type | Viscosity (cps.) |
| Blank | — | 1,600 | 67 | S | 60 | F | 1,500 |
| VI A | 0.10 | 950 | 0 | S | 68 | | |
| | 0.20 | 800 | 27 | S | 60 | F | 875 |
| | 0.50 | 800 | 40 | S | 60 | F | 825 |
| | 0.75 | 733 | 27 | S | 53 | F | 750 |

TABLE III B-continued

| Dispersant of Example | Conc. of Dispersant (Solids) % by wt. of coal | Sulfomethylated Phenol Initial Viscosity (cps.) | Sediment 1 Day % by wt. | Type | 7 Days % by wt. | Type | Final Viscosity (cps.) |
|---|---|---|---|---|---|---|---|
| VI B | 0.10 | 900 | 33 | S | 73 | F | 950 |
| | 0.20 | 800 | 33 | S | 53 | F | 825 |
| | 0.50 | 700 | 33 | S | 60 | F | 675 |
| | 0.75 | 600 | 27 | S | 60 | F | 575 |
| VI C | 0.10 | 900 | 33 | S | 73 | F | 900 |
| | 0.20 | 767 | 33 | S | 60 | F | 700 |
| | 0.50 | 633 | 40 | S | 60 | F | 600 |
| | 0.75 | 600 | 40 | S | 67 | F | 575 |
| VI D | 0.10 | 875 | 37 | S | 67 | F | 900 |
| | 0.20 | 850 | 27 | S | 67 | F | 850 |
| | 0.50 | 667 | 30 | S | 67 | F | 633 |
| | 0.75 | 600 | 30 | S | 50 | F | 600 |

TABLE III C

| Dispersant of Example | Conc. of Dispersant (Solids) % by wt. of coal | Sulfomethylated Bis-Phenol A Initial Viscosity (cps.) | Sediment 7 Days % by wt. | Type | Final Viscosity (cps.) |
|---|---|---|---|---|---|
| Blank | — | 1,600 | 47 | SF | 1,550 |
| VII A | 0.10 | 600 | 53 | SF | 633 |
| | 0.20 | 480 | 47 | SF | 455 |
| | 0.50 | 360 | 40 | SF | 360 |
| | 0.75 | 330 | 40 | SF | 330 |
| VII B | 0.10 | 600 | 33 | SF | 600 |
| | 0.20 | 460 | 40 | SF | 450 |
| | 0.50 | 300 | 40 | SF | 320 |
| | 0.75 | 300 | 40 | SF | 280 |
| VII C | 0.10 | 575 | 33 | SF | 550 |
| | 0.20 | 460 | 40 | SF | 460 |
| | 0.50 | 330 | 40 | SF | 320 |
| | 0.75 | 330 | 33 | SF | 320 |
| VII D | 0.10 | 575 | 47 | SF | 575 |
| | 0.20 | 435 | 60 | SF | 410 |
| | 0.50 | 330 | 53 | SF | 330 |
| | 0.75 | 280 | 47 | SF | 280 |

TABLE III D

| Dispersant of Example | Conc. of Dispersant (Solids) % by wt. of coal | Sulfomethylated Catechol Initial Viscosity (cps.) | Sediment 1 Day % by wt. | Type | 3 Days % by wt. | Type | Final Viscosity (cps.) |
|---|---|---|---|---|---|---|---|
| Blank | — | 1,100 | 80 | SF | 73 | F | 1,150 |
| VIII A | 0.10 | 1,030 | 67 | SF | 66 | F | 1,000 |
| | 0.20 | 950 | 60 | SF | 66 | F | 767 |
| | 0.50 | 875 | 60 | F | | | |
| | 0.75 | 800 | 60 | F | | | |
| VIII B | 0.10 | 950 | 67 | SF | 73 | F | 1,000 |
| | 0.20 | 925 | 60 | SF | 73 | F | 767 |
| | 0.50 | 825 | 60 | F | | | |
| | 0.75 | 800 | 60 | F | | | |
| VIII C | 0.10 | 925 | 53 | SF | 66 | F | 875 |
| | 0.20 | 925 | 67 | SF | 66 | F | 875 |
| | 0.50 | 825 | 53 | SF | 66 | F | 633 |
| | 0.75 | 800 | 53 | SF | 73 | F | 575 |
| VIII D | 0.10 | 925 | 53 | SF | 73 | F | 800 |
| | 0.20 | 925 | 47 | SF | 73 | F | 800 |
| | 0.50 | 875 | 40 | SF | 66 | F | 633 |
| | 0.75 | 767 | 40 | SF | 66 | F | 575 |

The various sulfomethylated styrenated phenols, sulfomethylated phenols, sulfomethylated bis-phenol A and sulfomethylated catechol all demonstrate dispersant properties and reduce the viscosity of the coal slurries significantly even when used at low concentration. Of these, sulfomethylated bis-phenol A is the most effective although not as effective as sulfomethylated resorcinol bottoms or sulfomethylated resorcinol bottoms further condensed with formaldehyde. Furthermore, the sulfomethylated resorcinol bottoms gives a soft easily dispersable sediment even after 7 days.

EXAMPLE IX (Sulfomethylation of 4,4'-dihydroxydiphenyl)

In a manner similar to Example V, the following were mixed together:

4,4' dihydroxydiphenyl (1.0 mole): 186 grams
water: 560 grams
sodium pyrosulfite (1.0 mole): 190 grams
50% by weight aqueous sodium hydroxide solution (2.75 mole): 220 grams
37% by weight aqueous solution of formaldehyde (2 moles): 162 grams This mixture was heated slowly to reflux and maintained at reflux for 54 hours. It was then cooled to 20° C. Additional water was added to make a clear solution. The solids content was found to be 36% by weight.

EXAMPLE X (Sulfomethylation of 4,4' dihydroxy diphenyl sulfone)

In a manner similar to Example V, a mixture of reactants was prepared as follows:

4,4' dihydroxy diphenyl sulfone (1 mole): 250 grams
water: 660 grams
50% by weight aqueous sodium hydroxide solution (2 mole): 160 grams
sodium pyrosulfite (1 mole): 190 grams 37% by weight aqueous solution of formaldehyde (2 moles): 162 grams This mixture was heated to reflux and maintained at reflux (110.0° C.) for 40 hours. It was then cooled to room temperature. The percent solids were found to be 36% by weight.

EXAMPLE XI (Condensation of Sulfomethylated Bisphenol A with Formaldehyde)

Into a 500 ml round bottom flask equipped with stirrer, thermometer and reflux condenser were added 300 grams (ca. 0.24 mole) of the sulfomethylated bisphenol A of Example VII (37% by weight solids) and 11.5 grams (0.14 mole) of 37% by weight aqueous solution of formaldehyde. This mixture was heated at reflux (110.0° C.) until analysis showed absence of unchanged formaldehyde. This required about 30 hours. The material was then cooled to ambient temperature. The solids concentration in the solution was found to be 35% by weight. The molar ratio of formaldehyde to sulfomethylated material was about 0.60:1.

EXAMPLE XII (Condensation of Sulfomethylated Bisphenol A with Formaldehyde)

In a manner identical to that of Example XI, 300 grams (0.24 mole) of sulfomethylated bisphenol A (37% by weight solids) were condensed with 19.2 grams (0.24 mole) of 37% by weight aqueous solution of formaldehyde. Reaction time was 32 hours. Concentration of solid material in the resulting solution was found to be 35% by weight. The molar ratio of formaldehyde to sulfomethylated material was about 1.0:1.0.

EXAMPLE XIII (Condensation of Sulfomethylated Bisphenol A with Formaldehyde)

In a manner identical to that of Example XI, 300 grams (0.24 mole) of sulfomethylated Bisphenol A were condensed with 23.8 grams (0.29 mole) of 37% by weight aqueous solution of formaldehyde. Reaction time was 33 hours. Concentration of solid material in the resulting solution was found to be 35%. The molar ratio of formaldehyde to sulfomethylated material was about 1.22:1.0.

The products of Examples IX, X, XI, XII and XIII were evaluated as dispersants for aqueous coal slurries using the previously described procedure. The data collected are set forth in Table IV below.

In Table IV, products of Examples IX, X, XI, XII and XIII were evaluated on Pittston coal, 80% <200 mesh U.S. Sieve Series. All dispersions contained 60% by weight of coal, based on total weight of the dispersion. The following is used to describe the sediment:

Soft—S
Semi-firm—SF
Firm—F

TABLE IV

| Dispersant of Example | Conc. of Dispersant (Solids) % by wt. of coal | Initial Viscosity (cps.) | Sediment 24 Hrs. % by wt. | Sediment 24 Hrs. Type | Sediment 4 Days % by wt. | Sediment 4 Days Type |
|---|---|---|---|---|---|---|
| Blank | — | >5000 | 33 | SF | 80 | F |
| IX | 0.1 | 2350 | 53 | SF | 67 | F |
| | 0.2 | 2350 | 53 | SF | 73 | F |
| | 0.5 | 1100 | 60 | SF | 73 | F |
| | 0.75 | 1150 | 62 | SF | 73 | F |
| X | 0.1 | 2375 | 20 | SF | 67 | F |
| | 0.2 | 1850 | 26 | SF | 67 | F |
| | 0.5 | 1100 | 40 | SF | 53 | F |
| | 0.75 | 1150 | 47 | SF | 60 | F |
| XI | 0.1 | 900 | 27 | F | | |
| | 0.2 | 733 | 33 | F | | |
| | 0.5 | 460 | 47 | F | | |
| | 0.75 | 460 | 60 | F | | |
| XII | 0.1 | 767 | 27 | F | | |
| | 0.2 | 575 | 47 | F | | |
| | 0.5 | 460 | 67 | F | | |
| | 0.75 | 460 | 67 | F | | |
| XIII | 0.1 | 575 | 33 | F | | |
| | 0.2 | 500 | 40 | F | | |
| | 0.5 | 480 | 67 | F | | |
| | 0.75 | 435 | 67 | F | | |

While the invention has been described with reference to certain specific embodiments thereof, it is understood that it is not to be so limited since alterations and changes may be made therein which are within the full intended scope of the appended claims.

What is claimed is:

1. An aqueous carbonaceous slurry containing at least one dispersant selected from the group consisting of (a) water soluble hydroxy aromatic product having the following formula:

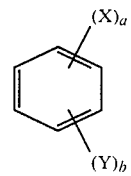

where

X is —OH or —O Cation

Y is

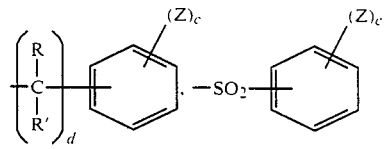

or R″ a is 1, 2 or 3; b is 0, 1 or 2 c is 0, 1 or 2; d is 0 or 1

Z is —OH or —O Cation

R and R′ are H or lower alkyl and may be the same or different

R″ is an alkyl group of 1 to 20 carbon atoms with the proviso that where a is 1, b is 0, 1 or 2 where a is 2, b is 0 or 1 and where a is 3, b is 0 which has been sulfomethylated, and (b) condensates of (a) with from about 0.25 to about 3.0 moles of formaldehyde per mole of (a), said dispersant present in an amount of from about 0.05% by weight to about 2.0% by weight of the carbonaceous material present in the slurry.

2. The slurry of claim 1 wherein said carbonaceous material is coal.

3. The slurry of claim 1 wherein said dispersant is sulfomethylated styrenated phenol.

4. The slurry of claim 1 wherein said dispersant is sulfomethylated phenol.

5. The slurry of claim 1 wherein said dispersant is sulfomethylated 2,2'-bis(p-hydroxyphenyl)propane.

6. The slurry of claim 1 wherein said dispersant is sulfomethylated 1,2-dihydroxy benzene.

7. The slurry of claim 1 wherein said dispersant is the water soluble sulfomethylation product of water soluble residue obtained from resorcinol production by the alkaline fusion method having the following composition:

Resorcinol: about 2 to about 8% by wt.
Dihydroxy diphenyl: about 12 to about 20% by wt.
Trihydroxy diphenyl: about 25 to about 35% by wt.
Higher molecular weight polymers: balance.

8. The slurry of claim 7 wherein said dispersant is in the form of its sodium, potassium, lithium or ammonium salt.

9. The slurry of claim 7 wherein said dispersant is the condensate of from about one to about three moles of formaldehyde per mole of said water soluble sulfomethylation product.

10. A process for preparing stable aqueous carbonaceous slurries comprising incorporating into said slurry the dispersant of claim 1 in an amount sufficient to reduce water content of the slurry, stabilize the network of carbonaceous material in water and improve pumpability.

11. The process of claim 10 wherein said carbonaceous material is coal.

12. The process of claim 11 wherein said dispersant is the water soluble sulfomethylation product of water soluble residue obtained from resorcinol production by the alkaline fusion method having the following composition:

Resorcinol: about 2 to about 8% by wt.
Dihydroxy diphenyl: about 12 to about 20% by wt.
Trihydroxy diphenyl: about 25 to about 35% by wt.
Higher molecular weight polymers: balance.

* * * * *